US006513443B2

(12) United States Patent
Todd

(10) Patent No.: US 6,513,443 B2
(45) Date of Patent: Feb. 4, 2003

(54) PORTABLE COLLAPSIBLE PULPIT

(76) Inventor: Ralph Todd, 1730 Drexel Dr., Lemon Grove, CA (US) 91945

( * ) Notice: Subject to any disclaimer, the term of this patent is extended or adjusted under 35 U.S.C. 154(b) by 0 days.

(21) Appl. No.: 09/882,401

(22) Filed: Jun. 18, 2001

(65) Prior Publication Data

US 2002/0189508 A1 Dec. 19, 2002

(51) Int. Cl.[7] ..... A47B 3/00
(52) U.S. Cl. ..... 108/115
(58) Field of Search ..... 108/115, 42, 43, 108/44, 35, 36, 38, 41, 167, 169, 170, 171, 175, 165, 166; 248/444, 459, 463

(56) References Cited

U.S. PATENT DOCUMENTS 1,851,600 A * 3/1932 Stanley
2,709,631 A * 5/1955 Covucci
2,770,513 A * 11/1956 Brown
2,837,394 A * 6/1958 Rahall
2,844,429 A * 7/1958 Frey
5,067,417 A * 11/1991 Marmentini et al.
5,315,935 A * 5/1994 Weisenfels
5,325,640 A * 7/1994 Luedke et al.
5,535,683 A * 7/1996 Novak
6,044,758 A * 4/2000 Drake

FOREIGN PATENT DOCUMENTS

JP 299456 * 10/2001

* cited by examiner

*Primary Examiner*—Jose V. Chen
(74) *Attorney, Agent, or Firm*—Charles C. Logan II

(57) ABSTRACT

A portable collapsible pulpit having a left top wall panel having a right edge and a right top wall panel having a left edge and said respective right edge and left edge are hinged together. Each of the top wall panels has an upstanding rear flange member adjacent their bottom edge. A left side support wall panel has its top edge pivotally hinged to the bottom surface of the left top wall panel adjacent its left edge. A right side support wall panel is pivotally hinged to the right top wall panel adjacent its right edge. A left front wall panel is pivotally hinged to a right front wall panel at their abstract side edges and their respective other side edge is pivotally hinged to the respective left side support wall panel and right side support wall panel adjacent their front edges. Handgrip slots are formed in the respective front wall panels both for the purpose of aiding in collapsing the pulpit and also for the purpose of carrying the pulpit in its collapsed state. The portable collapsible pulpit may be used on a table or desk top as a teaching aid in addition to being used on a church pew.

7 Claims, 2 Drawing Sheets

PORTABLE COLLAPSIBLE PULPIT

BACKGROUND OF THE INVENTION

The invention relates to a pulpit and more specifically to a portable collapsible pulpit.

The Meyer et al U.S. Pat. No. 3,129,032 discloses a portable lectern that is collapsible. It has structure for supporting it upon the backrest of a seat. It has a leg member whose top end is pivotally secured to the bottom surface of the article supporting member. It has a toggle brace mechanism that can be collapsed for folding the leg member upwardly into contact with the bottom surface of the supporting member.

A pulpit functions in a similar manner to that of a portable desk. The Coffrin U.S. Pat. No. 4,819,568 and the Maynard Jr. U.S. Pat. No. 4,969,698 disclose collapsible portable desk assemblies. The Petersen U.S. Pat. No. 6,041,723 also discloses a portable collapsible self assembling desk. Some prior art patents also disclose a portable hanging desk that can be hung from the back portion of a seat. An example of such a structure is illustrated in the Hansen U.S. Pat. No. 5,722,586. The Huff U.S. Pat. No. 4,893,363 discloses structure for a hanging wall table for a swimming pool.

It is an object of the invention to provide a novel pulpit that is both portable and collapsible.

It is also an object of the invention to provide a novel portable collapsible pulpit that has a pair of handgrip slots formed in its top wall panels that allow the pulpit to be carried conveniently in its collapsed state.

It is another object of the invention to provide a novel portable collapsible pulpit that is economical to manufacture and market.

It is a further object of the invention to provide a novel portable collapsible pulpit that can be removably positioned on the back member of a church pew.

It is an additional object of the invention to provide a novel portable collapsible pulpit that can be easily and quickly set up and later collapsed.

SUMMARY OF THE INVENTION

The novel portable collapsible pulpit has a pair of side-by-side top wall panels that are pivotally connected to each other by a hinge member attached to their respective bottom surfaces along their respective aligned side edges. Each of the top wall panels has an upstanding rear flange member that would prevent papers or other documents from sliding off their top surface. Each of the top wall panels has a handgrip slot that allows the adjacent inner side edges of the respective top wall panels to be lifted upwardly thereby aiding in collapsing the pulpit. The handgrip slots also provide a means for gripping the structure when carrying the collapsible pulpit in its collapsed state.

A left side support wall panel and a right side support wall panel each have a top edge that slopes downwardly from their front edge to their rear edge thus giving the top wall panel an inclined support surface. The top edges of the respective side support wall panels are pivotally connected to the bottom surface of the respective top wall panels adjacent their respective outer edges. The piano hinges are attached in a manner that allows the respective left side and right side support wall panels to fold away from the respective top wall panels to a collapsed position where they extend substantially outwardly from the outer side edges of the top wall panels.

A pair of upright oriented front wall panels have their respective inner side edges pivotally connected together by a piano hinge. Their respective outer side edges are pivotally connected to piano hinges that are connected to the front edges of the respective left side and right side support wall panels. These piano hinges are positioned so that as the top wall panels are lifted upwardly, the front wall panels will collapse inwardly between the respective left side and right side support wall panels.

DESCRIPTION OF THE PREFERRED EMBODIMENT

Figure 1:
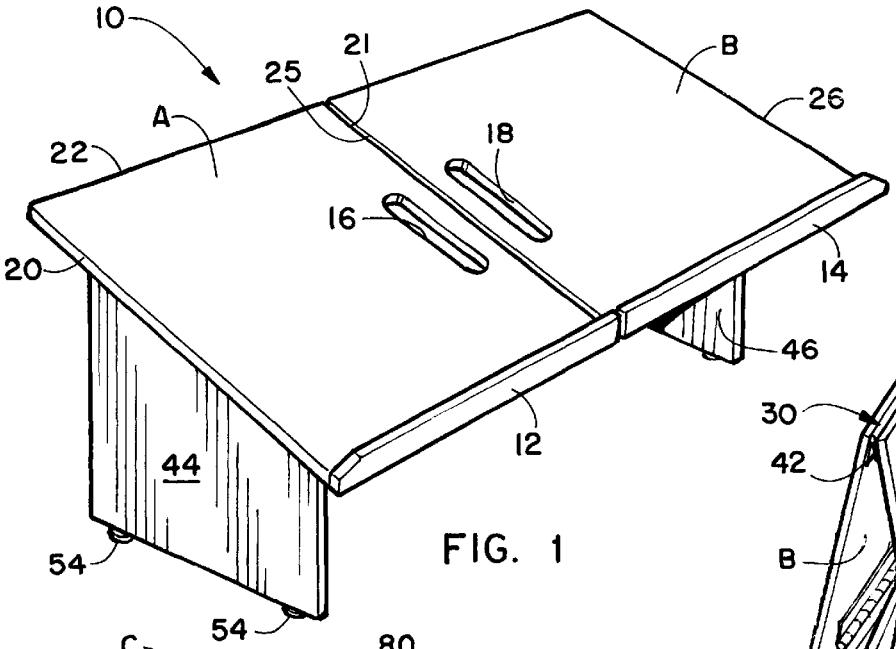
FIG. 1 is a rear perspective view of the novel portable collapsible pulpit.

Referring to FIGS. 1–5, the portable collapsible pulpit 10 will now be described. It has a top wall panel A and a top wall panel B. Each panel has an upstanding rear flange member hat is respectively designated numerals 12 and 14. A handgrip slot 16 is formed in top wall panel A and a handgrip slot 18 is formed in top wall panel B.

Top wall panel A has a left edge 20, a right edge 21, a front edge 22 and a rear edge 23. Top wall panel B has a left edge 25, a right edge 26, a front edge 27 and a rear edge 28. A piano hinge 30 is attached to the bottom surface of the respective top wall panels A and B adjacent the respective side edges 21 and 25. Piano hinge 30 has a left flange plate 31 having a plurality of longitudinally spaced screw apertures 32 along its length. Left flange plate 31 also has longitudinally spaced tubular sleeves 34 along its entire length. Right flange plate 36 has a plurality of longitudinally spaced screw apertures 37 and a plurality of tubular sleeves 39 longitudinally spaced from each other along its entire length. The respective tubular sleeves 34 and 39 intermesh with each other to form a longitudinal axis for receiving a hinge pin 42.

Figure 2:
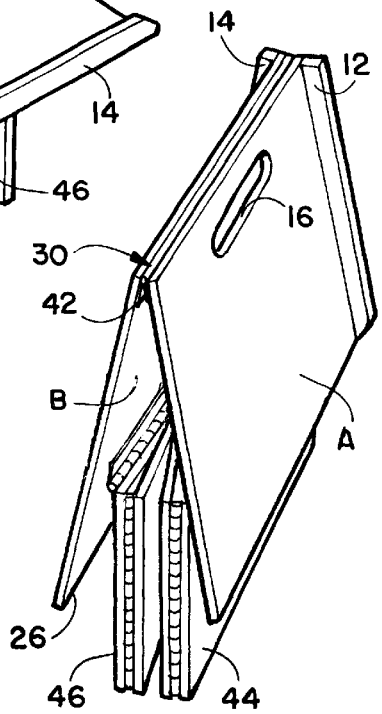
FIG. 2 is a front perspective view of the portable collapsible pulpit in its collapsed state.

Left side support wall panel 44 and right side support wall panel 46 are identical and each has a top edge, a bottom edge, a front edge, and a rear edge. A piano hinge 48 is attached to the bottom surface of top wall panel A and the top edge of left side support wall panel 44. A piano hinge 50 is attached to the bottom surface of top wall panel B and the top edge of right side support panel 46. Piano hinges 48 and 50 have a structure identical to that of piano hinge 30. A pair of tack guides 54 are connected to the bottom edge of the respective left and right side support wall panels 44 and 46. FIG. 2 shows the portable collapsible pulpit 10 in its collapsed state. Left side support wall panel 44 is shown in a position extending substantially outwardly from left edge 20 of top wall panel A. Right side support wall 46 is shown to be extending substantially outwardly from right edge 26 of top wall panel B.

Figure 3:
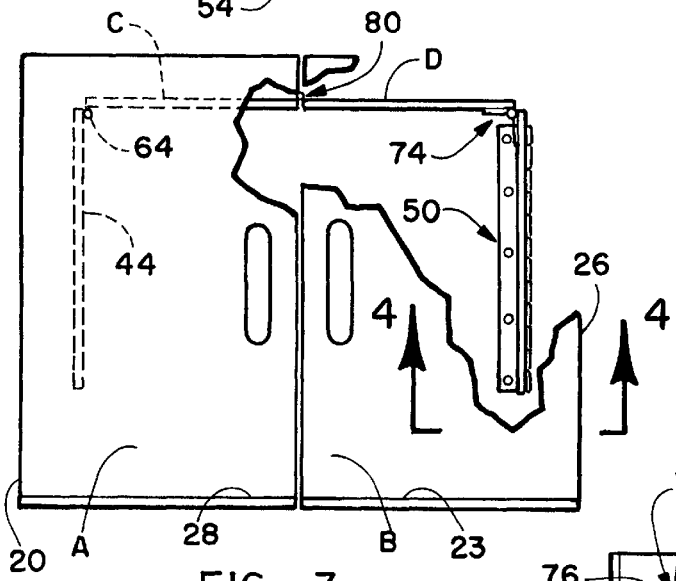
FIG. 3 is a top plan view of the portable collapsible pulpit with portions broken away.
Figure 4:
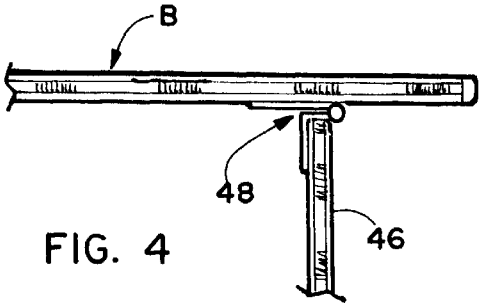
FIG. 4 is a cross sectional view taken along lines 4—4 of FIG. 3.
Figure 5:
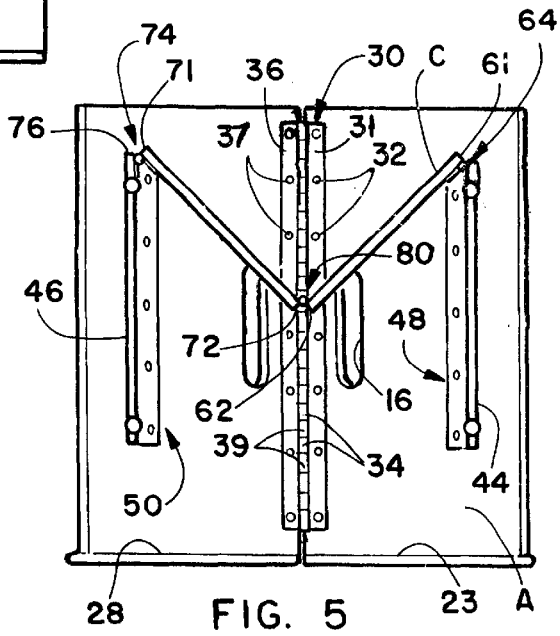
FIG. 5 is a bottom plan view of the portable collapsible pulpit with its top wall panels partially open from its collapsed state.

Front wall panel C has a top edge, a bottom edge, a left edge 61 and a right edge 62. A piano hinge 64 connects left edge 61 to the front edge 66 of left side support wall panel 44. Front wall panel D has a top edge, a bottom edge, a left edge 72 and a right edge 71. A piano hinge 74 pivotally connects the right edge 71 of front wall panel D to the front edge 76 of right side support wall panel 46. A piano hinge 80 connects the right side edge 62 of front wall panel C to the left side edge 72 of front wall panel D. Piano hinges 64, 74 and 80 are identical to piano hinge 30. FIG. 3 is a top plan view showing portable collapsible pulpit 10 in its fully extended set up state. Front wall panels C and D are positioned in the same vertical plane. FIG. 5 is a partially opened bottom plan view showing how front wall panels C and D collapse inwardly toward each other to their collapsed position that is illustrated in FIG. 2.

Figure 6:
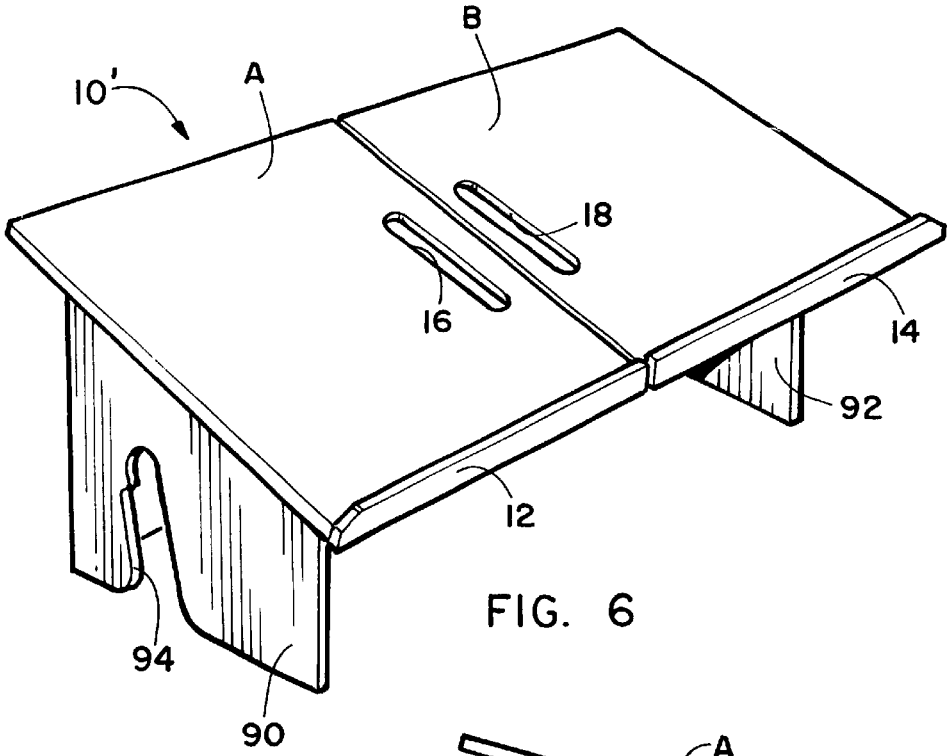
FIG. 6 is a rear perspective view of an alternative embodiment of the portable collapsible pulpit.
Figure 7:
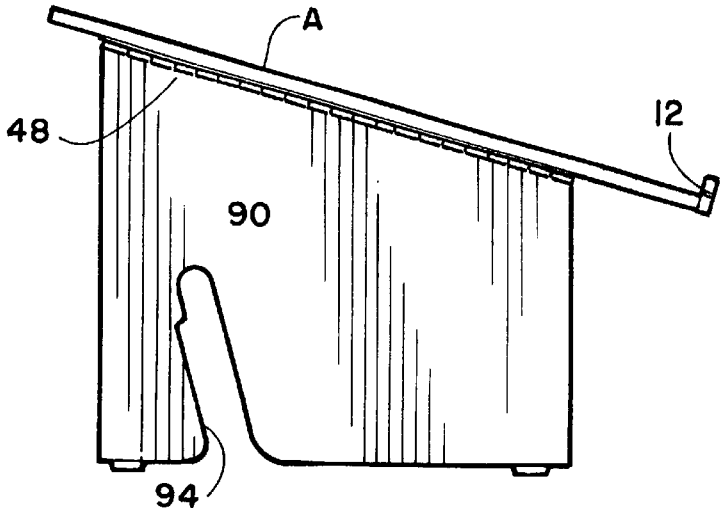
FIG. 7 is a side elevation view of the alternative embodiment of the portable collapsible pulpit.

An alternative embodiment portable collapsible pulpit 10' is illustrated in FIGS. 6 and 7. All of the structure is identical to that of portable collapsible pulpit 10 except left side support wall panel 90 and right side support wall panel 92. Each of these support wall panels have a slot 94 extending upwardly at an acute angle to their bottom edge. These church pew slots alow the pulpit 10' to be removably positioned on the back member of a church pew. The remaining structure of the alternative embodiment has the same numerals as that of the embodiment illustrated in FIGS. 1–5. The portable collapsible pulpit may be used on a table or desk top as a teaching aid in addition to being used on a church pew.

What is claimed is:

1. A portable collapsible pulpit comprising:

a top wall panel A having a front edge, a rear edge, a left edge, a right edge, a top surface and a bottom surface;

a top wall panel B having a front edge, a rear edge, a left edge, a right edge, a top surface and a bottom surface;

first hinge means connecting said right edge of said top wall panel A to said left edge of said top wall panel B so that said top wall panel A can be pivoted toward said top wall panel B to a collapsed position;

left side support means having a top edge, a front edge, a rear edge, a bottom edge and being transversely oriented to said bottom surface of said top wall panel A;

second hinge means connecting said top edge of said left side support means to said bottom surface of said top wall panel A so that said left side support means can be pivoted away from said top wall panel A to a position extending substantially outwardly from said left edge of said top wall panel A;

right side support means having a top edge, a bottom edge, a front edge, a rear edge, and being transversely oriented to said bottom surface of said top wall panel B;

third hinge means connecting said top edge of said right side support means to said bottom surface of said top wall panel B so that said right side support means can be pivoted away from said top wall panel B to a position extending substantially outwardly from said right edge of said top wall panel B;

an upstanding flange member adjacent said rear edge of each of said top wall panel A and said top wall panel B; and a handgrip slot in said top wall panel A adjacent its said right edge and a handgrip slot in said top wall panel B adjacent its said left edge both for the purpose of aiding in collapsing said pulpit and also for the purpose of carrying said pulpit in its collapsed state.

2. A portable collapsible pulpit as recited in claim 1 wherein said first hinge means is a piano hinge having a left flange plate and a right flange plate.

3. A portable collapsible pulpit as recited in claim 2 wherein said left plate and said right flange plate are fastened respectively to said bottom surface of said top wall panel A and said top wall panel B.

4. A portable collapsible pulpit as recited in claim 2 wherein said second hinge means is a piano hinge having a left flange plate and a right flange plate.

5. A portable collapsible pulpit as recited in claim 4 wherein said third hinge means is a piano hinge having a left flange plate and a right flange plate.

6. A portable collapsible pulpit comprising:

a top wall panel A having a front edge, a rear edge, a left edge, a right edge, a top surface and a bottom surface;

a top wall panel B having a front edge, a rear edge, a left edge, a right edge, a top surface and a bottom surface;

first hinge means connecting said right edge of said top wall panel A to said left edge of said top wall panel B so that said top wall panel A can be pivoted toward said top wall panel B to a collapsed position;

left side support means having a top edge, a front edge, a rear edge, a bottom edge and being transversely oriented to said bottom surface of said top wall panel A;

second hinge means connecting said top edge of said left side support means to said bottom surface of said top wall panel A so that said left side support means can be pivoted away from said top wall panel A to a position extending substantially outwardly from said left edge of said top wall panel A;

right side support means having a top edge, a bottom edge, a front edge, a rear edge, and being transversely oriented to said bottom surface of said top wall panel B;

third hinge means connecting said top edge of said right side support means to said bottom surface of said top wall panel B so that said right side support means can be pivoted away from said top wall panel B to a position extending substantially outwardly from said right edge of said top wall panel B;

an upstanding flange member adjacent said rear edge of each of said top wall panel A and said top wall panel B;

said left side support means and said right side support means are wall panels having a front edge and a rear edge and their said top edge is sloped downwardly from their said front edge to their said rear edge; and said side wall panels have a church pew slot in their said bottom edges that extend upwardly toward their said top edges at an acute angle; said church pew slots allow said pulpit to be removably positioned on the back member of a church pew.

7. A portable collapsible pulpit comprising:

a top wall panel A having a front edge, a rear edge, a left edge, a right edge, a top surface and a bottom surface;

a top wall panel B having a front edge, a rear edge, a left edge, a right edge, a top surface and a bottom surface;

first hinge means connecting said right edge of said top wall panel A to said left edge of said top wall panel B so that said top wall panel A can be pivoted toward said top wall panel B to a collapsed position;

left side support means having a top edge, a front edge, a rear edge, a bottom edge and being transversely oriented to said bottom surface of said top wall panel A;

second hinge means connecting said top edge of said left side support means to said bottom surface of said top wall panel A so that said left side support means can be pivoted away from said top wall panel A to a position extending substantially outwardly from said left edge of said top wall panel A;

right side support means having a top edge, a bottom edge, a front edge, a rear edge, and being transversely oriented to said bottom surface of said top wall panel B;

third hinge means connecting said top edge of said right side support means to said bottom surface of said top wall panel B so that said right side support means can be pivoted away from said top wall panel B to a position extending substantially outwardly from said right edge of said top wall panel B;

an upstanding flange member adjacent said rear edge of each of said top wall panel A and said top wall panel B; said left side support means and said right side support means are wall panels having a front edge and a rear edge and their said top edge is sloped downwardly from their said front edge to their said rear edge; and an upright oriented front wall panel C having a left edge and a right edge; an upright oriented front wall panel D having a left edge and a right edge; a fourth hinge means connecting said left edge of said front wall panel C adjacent said front edge of said left side support wall panel; a fifth hinge means connecting said right edge of said front wall panel D adjacent said front edge of said right side support wall panel; and a sixth hinge means connecting said right edge of said front wall panel C to said left edge of said front wall panel D.

* * * * *